US010480852B2

(12) United States Patent
Bardon et al.

(10) Patent No.: US 10,480,852 B2
(45) Date of Patent: Nov. 19, 2019

(54) SYSTEM AND METHOD FOR LIQUEFACTION OF NATURAL GAS

(71) Applicant: Dresser-Rand Company, Olean, NY (US)

(72) Inventors: Patrice Bardon, Sainte Adresse (FR); Hongpyo Kim, Houston, TX (US); Matthew Romeike, Ft. Collins, CO (US)

(73) Assignee: DRESSER-RAND COMPANY, Olean, NY (US)

( * ) Notice: Subject to any disclaimer, the term of this patent is extended or adjusted under 35 U.S.C. 154(b) by 42 days.

(21) Appl. No.: 15/533,409

(22) PCT Filed: Dec. 3, 2015

(86) PCT No.: PCT/US2015/063631

§ 371 (c)(1),
(2) Date: Jun. 6, 2017

(87) PCT Pub. No.: WO2016/094168

PCT Pub. Date: Jun. 16, 2016

(65) Prior Publication Data

US 2017/0370639 A1 Dec. 28, 2017

Related U.S. Application Data

(60) Provisional application No. 62/090,942, filed on Dec. 12, 2014.

(51) Int. Cl.
*F25J 1/00* (2006.01)
*F25J 1/02* (2006.01)

(52) U.S. Cl.
CPC ..... *F25J 1/0291* (2013.01); *F25J 1/0022* (2013.01); *F25J 1/0055* (2013.01); *F25J 1/0212* (2013.01)

(58) Field of Classification Search
CPC ..... F25J 1/0291; F25J 1/0022; F25J 1/0055; F25J 1/0097; F25J 1/0212
See application file for complete search history.

(56) References Cited

U.S. PATENT DOCUMENTS 4,033,735 A 7/1977 Swenson
4,539,028 A 9/1985 Paradowski et al.
(Continued)

FOREIGN PATENT DOCUMENTS

EP 0153649 B1 4/1991
JP 2007526430 A 9/2007
WO 2014189261 A1 11/2014

OTHER PUBLICATIONS

PCT International Search Report and Written Opinion dated Mar. 22, 2016 corresponding to PCT Application PCT/US2015/063631 filed Dec. 3, 2015.

*Primary Examiner* — Travis C Ruby

(57) ABSTRACT

A liquefaction system and method for producing liquefied natural gas (LNG) is provided. The liquefaction system may include a heat exchanger to cool natural gas to LNG, a first compressor to compress and combine first and second portions of a single mixed refrigerant from the heat exchanger, a first cooler to cool the single mixed refrigerant from the first compressor to a first liquid phase and a gaseous phase, and a first liquid separator to separate the first liquid phase from the gaseous phase. The liquefaction system may also include a second compressor to compress the gaseous phase, a second cooler to cool the compressed gaseous phase to a second liquid phase and the second portion of the single mixed refrigerant, a second liquid separator to separate the second liquid phase from the second portion of the single mixed refrigerant, and a pump to pressurize the first liquid phase.

20 Claims, 3 Drawing Sheets

(56) References Cited

U.S. PATENT DOCUMENTS

| | | | |
|---|---|---|---|
| 5,791,160 | A | 8/1998 | Mandler et al. |
| 6,158,240 | A | 12/2000 | Low et al. |
| 6,272,882 | B1 | 8/2001 | Hodges et al. |
| 6,347,531 | B1 | 2/2002 | Roberts et al. |
| 6,742,357 | B1 | 6/2004 | Roberts |
| 6,962,060 | B2 | 11/2005 | Petrowski et al. |
| 7,086,251 | B2 | 8/2006 | Roberts |
| 7,127,914 | B2 | 10/2006 | Roberts et al. |
| 8,181,481 | B2 | 5/2012 | Jager |
| 8,561,425 | B2 | 10/2013 | Mitra et al. |
| 2003/0089125 | A1 | 5/2003 | Fredheim et al. |
| 2004/0182108 | A1 | 9/2004 | Roberts |
| 2008/0141711 | A1 | 6/2008 | Roberts et al. |
| 2009/0314030 | A1 | 12/2009 | Jager |
| 2010/0147024 | A1 | 6/2010 | Roberts et al. |
| 2010/0293997 | A1 | 11/2010 | Chantant et al. |
| 2012/0067080 | A1 | 3/2012 | Byfield et al. |
| 2013/0008204 | A1 | 1/2013 | Kim et al. |
| 2013/0026362 | A1 | 1/2013 | Biber et al. |
| 2013/0133362 | A1 | 5/2013 | Lee et al. |
| 2013/0263623 | A1 | 10/2013 | Lee et al. |
| 2014/0283548 | A1 | 9/2014 | He et al. |

SYSTEM AND METHOD FOR LIQUEFACTION OF NATURAL GAS

CROSS-REFERENCE TO RELATED APPLICATIONS

This application claims the benefit of U.S. Provisional Patent Application having Ser. No. 62/090,942, which was filed Dec. 12, 2014. The aforementioned patent application is hereby incorporated by reference in its entirety into the present application to the extent consistent with the present application.

BACKGROUND

The combustion of conventional fuels, such as gasoline and diesel, has proven to be essential in a myriad of industrial processes. The combustion of gasoline and diesel, however, may often be accompanied by various drawbacks including increased production costs and increased carbon emissions. In view of the foregoing, recent efforts have focused on alternative fuels with decreased carbon emissions, such as natural gas, to combat the drawbacks of combusting conventional fuels. In addition to providing a "cleaner" alternative fuel with decreased carbon emissions, combusting natural gas may also be relatively safer than combusting conventional fuels. For example, the relatively low density of natural gas allows it to safely and readily dissipate to the atmosphere in the event of a leak. In contrast, conventional fuels (e.g., gasoline and diesel) have a relatively high density and tend to settle or accumulate in the event of a leak, which may present a hazardous and potentially fatal working environment for nearby operators.

While utilizing natural gas may address some of the drawbacks of conventional fuels, the storage and transport of natural gas often prevents it from being viewed as a viable alternative to conventional fuels. Accordingly, natural gas is routinely converted to liquefied natural gas (LNG) via one or more thermodynamic processes. The thermodynamic processes utilized to convert natural gas to LNG may often include circulating one or more refrigerants (e.g., single mixed refrigerants, duel mixed refrigerants, etc.) through a refrigerant cycle. While various thermodynamic processes have been developed for the production of LNG, conventional thermodynamic processes may often fail to produce LNG in quantities sufficient to meet increased demand. Further, the complexity of the conventional thermodynamic processes may often make the production of LNG cost prohibitive and/or impractical. For example, the production of LNG via conventional thermodynamic processes may often require the utilization of additional and/or cost-prohibitive equipment (e.g., compressors, heat exchangers, etc.).

What is needed, then, is an improved, simplified liquefaction system and method for producing liquefied natural gas (LNG).

BRIEF DESCRIPTION

Embodiments of the disclosure may provide a method for producing liquefied natural gas. The method may include feeding natural gas through a heat exchanger. The method may also include compressing a first portion of a single mixed refrigerant in a first compressor, and compressing a second portion of the single mixed refrigerant in the first compressor. The method may further include combining the first portion of the single mixed refrigerant with the second portion of the single mixed refrigerant in the first compressor to produce the single mixed refrigerant. The method may also include cooling the single mixed refrigerant in a first cooler to produce a first liquid phase and a gaseous phase, and separating the first liquid phase from the gaseous phase in a first liquid separator. The method may further include compressing the gaseous phase in a second compressor, and cooling the compressed gaseous phase in a second cooler to produce a second liquid phase and the second portion of the single mixed refrigerant. The method may also include separating the second liquid phase from the second portion of the single mixed refrigerant in a second liquid separator. The method may also include pressurizing the first liquid phase in a pump, and combining the first liquid phase with the second liquid phase to produce the first portion of the single mixed refrigerant. The method may further include feeding the first portion of the single mixed refrigerant and the second portion of the single mixed refrigerant to the heat exchanger to cool at least a portion of the natural gas flowing therethrough to thereby produce the liquefied natural gas.

Embodiments of the disclosure may also provide a method for producing liquefied natural gas from a natural gas source. The method may include feeding natural gas from the natural gas source to and through a heat exchanger. The method may also include feeding a first portion of a single mixed refrigerant from the heat exchanger to a first stage of a first compressor, and compressing the first portion of the single mixed refrigerant in the first compressor. The method may further include feeding a second portion of the single mixed refrigerant from the heat exchanger to an intermediate stage of the first compressor, compressing the second portion of the single mixed refrigerant in the first compressor, and combining the first portion of the single mixed refrigerant with the second portion of the single mixed refrigerant in the first compressor to produce the single mixed refrigerant. The method may also include condensing at least a portion of the single mixed refrigerant in a first cooler fluidly coupled with the first compressor to produce a first liquid phase and a gaseous phase, and separating the first liquid phase from the gaseous phase in a first liquid separator fluidly coupled with the first cooler. The method may further include compressing the gaseous phase in a second compressor fluidly coupled with the first liquid separator. The method may also include cooling the compressed gaseous phase in a second cooler fluidly coupled with the second compressor to produce a second liquid phase and the second portion of the single mixed refrigerant, and separating the second liquid phase from the second portion of the single mixed refrigerant in a second liquid separator. The method may also include pressurizing the first liquid phase in a pump fluidly coupled with the first liquid separator, and combining the first liquid phase from the pump with the second liquid phase from the second liquid separator to produce the first portion of the single mixed refrigerant. The method may also include feeding the first portion of the single mixed refrigerant and the second portion of the single mixed refrigerant to the heat exchanger to cool at least a portion of the natural gas flowing through the heat exchanger to produce the liquefied natural gas.

Embodiments of the disclosure may further provide a liquefaction system. The liquefaction system may include a heat exchanger and a first compressor fluidly coupled with the heat exchanger. The heat exchanger may be configured to receive natural gas and cool at least a portion of the natural gas to liquefied natural gas. The first compressor may be configured to compress a first portion of a single mixed refrigerant and a second portion of the single mixed refrigerant from the heat exchanger, and combine the first and second portions of the single mixed refrigerant with one another to produce the single mixed refrigerant. The liquefaction system may also include a first cooler fluidly coupled with the first compressor and configured to cool the single mixed refrigerant from the first compressor to produce a first liquid phase and a gaseous phase. A first liquid separator may be fluidly coupled with the first cooler and configured to separate the first liquid phase from the gaseous phase. A second compressor may be fluidly coupled with the first liquid separator and configured to compress the gaseous phase from the first liquid separator. The liquefaction system may further include a second cooler fluidly coupled with the second compressor and configured to cool the compressed gaseous phase from the second compressor to produce a second liquid phase and a second portion of the single mixed refrigerant. A second liquid separator may be fluidly coupled with the second cooler and the heat exchanger and configured to separate the second liquid phase from the second portion of the single mixed refrigerant, and discharge the second portion of the single mixed refrigerant to the heat exchanger. A pump may be fluidly coupled with the first liquid separator and the heat exchanger, and configured to pressurize the first liquid phase from the first liquid separator to combine the first liquid phase with the second liquid phase from the second liquid separator to produce the first portion of the single mixed refrigerant.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
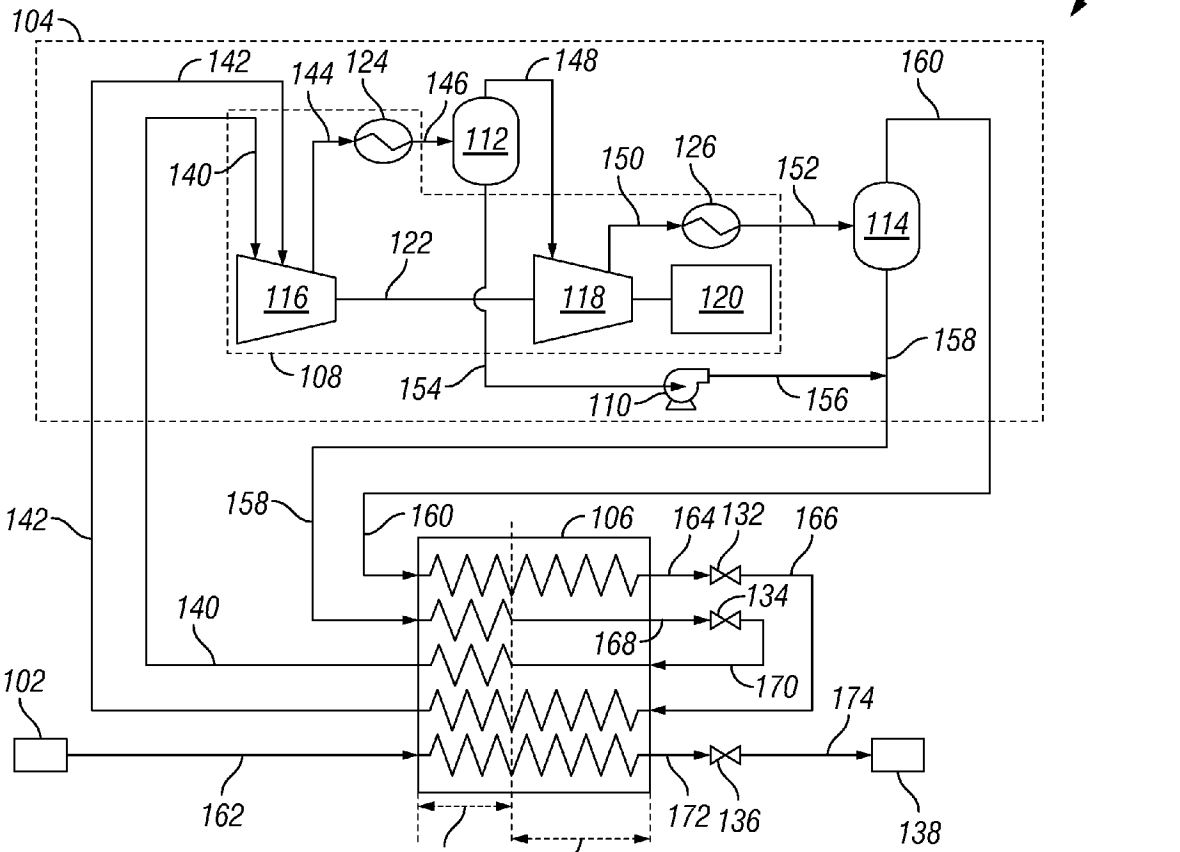
FIG. 1 illustrates a process flow diagram of an exemplary liquefaction system for producing liquefied natural gas (LNG) from a natural gas source, according to one or more embodiments disclosed.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1 illustrates a process flow diagram of an exemplary liquefaction system 100 for producing liquefied natural gas (LNG) from a natural gas source 102, according to one or more embodiments. As further discussed herein, the liquefaction system 100 may be configured to receive natural gas or feed gas from the natural gas source 102, direct or flow the feed gas through a product or feed gas stream to cool at least a portion of the feed gas to the LNG, and discharge or output the LNG. The liquefaction system 100 may also be configured to direct or flow a process fluid containing one or more refrigerants (e.g., a single mixed refrigerant) through one or more refrigerant cycles (e.g., pre-cooling cycle, liquefaction cycle, etc.) to cool at least a portion of the feed gas flowing through the feed gas stream.

The liquefaction system 100 may include one or more refrigerant assemblies (one is shown 104) and one or more heat exchangers (one is shown 106). The refrigerant assembly 104 may include a compression assembly 108, one or more pumps (one is shown 110), one or more liquid separators (two are shown 112, 114), or any combination thereof, fluidly, communicably, thermally, and/or operatively coupled with one another. The refrigerant assembly 104 may be fluidly coupled with the heat exchanger 106. For example, as illustrated in FIG. 1, the refrigerant assembly 104 may be fluidly coupled with and dispose upstream of the heat exchanger 106 via lines 158 and 160, and may further be fluidly coupled with and disposed downstream from the heat exchanger 106 via lines 140 and 142. While FIG. 1 illustrates a single refrigerant assembly 104 fluidly coupled with the heat exchanger 106, it should be appreciated that the liquefaction system 100 may include a plurality of refrigerant assemblies. For example, two or more refrigerant assemblies may be fluidly coupled with a single heat exchanger 106 in series or in parallel. Similarly, two or more heat exchangers may be fluidly coupled with a single refrigerant assembly 104 in series or in parallel.

The natural gas source 102 may be or include a natural gas pipeline, a stranded natural gas wellhead, or the like, or any combination thereof. The natural gas source 102 may contain natural gas at ambient temperature. The natural gas source 102 may contain natural gas having a temperature relatively greater than or relatively less than ambient temperature. The natural gas source 102 may also contain natural gas at a relatively high pressure (e.g., about 3,400 kPa to about 8,400 kPa or greater) or a relatively low pressure (e.g., about 100 kPa to about 3,400 kPa). For example, the natural gas source 102 may be a high pressure natural gas pipeline containing natural gas at a pressure from about 3,400 kPa to about 8,400 kPa or greater. In another example, the natural gas source 102 may be a low pressure natural gas pipeline containing natural gas at a pressure from about 100 kPa to about 3,500 kPa.

The natural gas from the natural gas source 102 may include one or more hydrocarbons. For example, the natural gas may include methane, ethane, propane, butanes, pentanes, or the like, or any combination thereof. Methane may be a major component of the natural gas. For example, the concentration of methane in the natural gas may be greater than about 80%, greater than about 85%, greater than about 90%, or greater than about 95%. The natural gas may also include one or more non-hydrocarbons. For example, the natural gas may be or include a mixture of one or more hydrocarbons and one or more non-hydrocarbons. Illustrative non-hydrocarbons may include, but are not limited to, water, carbon dioxide, helium, nitrogen, or the like, or any combination thereof. The natural gas may be treated to separate or remove at least a portion of the non-hydrocarbons from the natural gas. For example, the natural gas may be flowed through a separator (not shown) containing one or more adsorbents (e.g., molecular sieves, zeolites, metal-organic frameworks, etc.) configured to at least partially separate one or more of the non-hydrocarbons from the natural gas. In an exemplary embodiment, the natural gas may be treated to separate the non-hydrocarbons (e.g., water and/or carbon dioxide) from the natural gas to increase a concentration of the hydrocarbon and/or prevent the natural gas from subsequently crystallizing (e.g., freezing) in one or more portions of the liquefaction system 100. For example, in one or more portions of the liquefaction system 100, the feed gas containing the natural gas may be cooled to or below a freezing point of one or more of the non-hydrocarbons (e.g., water and/or carbon dioxide). Accordingly, removing water and/or carbon dioxide from the natural gas may prevent the subsequent crystallization of the feed gas in the liquefaction system 100.

The compression assembly 108 of the refrigerant assembly 104 may be configured to compress the process fluid (e.g., mixed refrigerant process fluid) directed thereto. For example, the compression assembly 108 may include one or more compressors (two are shown 116, 118) configured to compress the process fluid. In an exemplary embodiment, the compression assembly 108 may include only two compressors 116, 118. For example, as illustrated in FIG. 1, a first compressor 116 of the compression assembly 108 may be fluidly coupled with and disposed downstream from the heat exchanger 106 via line 140 and line 142, and a second compressor 118 may be fluidly coupled with and disposed downstream from a first liquid separator 112 via line 148. It should be appreciated that utilizing only two compressors 116, 118 in the compression assembly 108 may reduce the cost, energy consumption, and/or complexity of the liquefaction system 100. For example, utilizing only two compressors 116, 118 may reduce the number of drivers 120, coolers 124, 126, liquid separators 112, 114, and/or pumps 110 utilized in the liquefaction system 100. In another embodiment, the compression assembly 108 may include any number of compressors. For example, the compression assembly 108 may include three, four, five, or more compressors. Illustrative compressors may include, but are not limited to, supersonic compressors, centrifugal compressors, axial flow compressors, reciprocating compressors, rotating screw compressors, rotary vane compressors, scroll compressors, diaphragm compressors, or the like, or any combination thereof.

Each of the compressors 116, 118 may include one or more stages (not shown). For example, each of the compressors 116, 118 may include a first stage, a final stage, and/or one or more intermediate stages disposed between the first stage and the final stage. In an exemplary embodiment, the first stage (not shown) of the first compressor 116 may be fluidly coupled with and disposed downstream from the heat exchanger 106 via line 140, and an intermediate stage (not shown) of the first compressor 116 may be fluidly coupled with and disposed downstream from the heat exchanger 106 via line 142. As further described herein, the first compressor 116 may be configured to receive a heated or "spent" first portion of a refrigerant (e.g., a single mixed refrigerant) from the heat exchanger 106 at the first stage thereof, and a sidestream of a "spent" second portion of the refrigerant (e.g., the single mixed refrigerant) from the heat exchanger 106 at the intermediate stage thereof. For example, the first compressor 116 may have a first inlet (not shown) fluidly and/or operably coupled with the first stage and configured to receive the spent first portion of the single mixed refrigerant, and a second inlet (not shown) fluidly and/or operably coupled with the intermediate stage and configured to receive the sidestream of the "spent" second portion of the single mixed refrigerant.

The compression assembly 108 may also include one or more drivers (one is shown 120) operatively coupled with and configured to drive each of the compressors 116, 118 and/or the respective compressor stages thereof. For example, as illustrated in FIG. 1, the driver 120 may be coupled with and configured to drive both of the compressors 116, 118 via a rotary shaft 122. In another example, separate drivers (not shown) may be coupled with and configured to drive each of the compressors 116, 118 via separate rotary shafts (not shown). Illustrative drivers may include, but are not limited to, motors (e.g., electric motors), turbines (e.g., gas turbines, steam turbines, etc.), internal combustion engines, and/or any other devices capable of driving each of the compressors 116, 118 or the respective compressor stages thereof. The rotary shaft 122 may be a single segment or multiple segments coupled with one another via one or more gears (not shown) and/or one or more couplers. It should be appreciated that the gears coupling the multiple segments of the rotary shaft 122 may allow each of the multiple segments of the rotary shaft 122 to rotate or spin at the same or different rates or speeds.

The compression assembly 108 may also include one or more heat exchangers or coolers (two are shown 124, 126) configured to absorb or remove heat from the process fluid (e.g., the refrigerant) flowing therethrough. The coolers 124, 126 may be fluidly coupled with and disposed downstream from the respective compressors 116, 118. For example, as illustrated in FIG. 1, a first cooler 124 may be fluidly coupled with and disposed downstream from the first compressor 116 via line 144, and a second cooler 126 may be fluidly coupled with and disposed downstream from the second compressor 118 via line 150. As further illustrated in FIG. 1, the first cooler 124 and the second cooler 126 may be fluidly coupled with and disposed upstream of the first liquid separator 112 and a second liquid separator 114 via line 146 and line 152, respectively. The first and second coolers 124, 126 may be configured to remove at least a portion of the thermal energy or heat generated in the first and second compressors 116, 118, respectively. For example, compressing the process fluid (e.g., the refrigerant) in the compressors 116, 118 may generate heat (e.g., heat of compression) in the process fluid, and the coolers 124, 126 may be configured to remove at least a portion of the heat of compression from the process fluid and/or the refrigerants contained therein.

In at least one embodiment, a heat transfer medium may flow through each of the coolers 124, 126 to absorb the heat in the process fluid flowing therethrough. Accordingly, the heat transfer medium may have a higher temperature when discharged from the coolers 124, 126 and the process fluid may have a lower temperature when discharged from the coolers 124, 126. The heat transfer medium may be or include water, steam, a refrigerant, a process gas, such as carbon dioxide, propane, or natural gas, or the like, or any combination thereof. In an exemplary embodiment, the heat transfer medium discharged from the coolers 124, 126 may provide supplemental heating to one or more portions and/or assemblies of the liquefaction system 100. For example, the heat transfer medium containing the heat absorbed from the coolers 124, 126 may provide supplemental heating to a heat recovery unit (HRU) (not shown).

The liquid separators 112, 114 may be fluidly coupled with and disposed downstream from the respective coolers 124, 126 of the compression assembly 108. For example, as illustrated in FIG. 1, a first liquid separator 112 and a second liquid separator 114 may be fluidly coupled with and disposed downstream from the first cooler 124 and the second cooler 126 via line 146 and line 152, respectively. As further illustrated in FIG. 1, the first liquid separator 112 may be fluidly coupled with and disposed upstream of the second compressor 118 and the pump 110 via line 148 and line 154, respectively, and the second liquid separator 114 may be fluidly coupled with and disposed upstream of the heat exchanger 106 via lines 158 and 160. The first and second liquid separators 112, 114 may each be configured to receive a process fluid containing a liquid phase (e.g., a liquid refrigerant) and a gaseous phase (e.g., a vapor or gaseous refrigerant), and separate the liquid phase and the gaseous phase from one another. For example, as further described herein, the first and second liquid separators 112, 114 may be configured to separate a liquid phase containing relatively high boiling point refrigerants (e.g., liquid refrigerant) and a gaseous phase containing relatively lower boiling point refrigerants (e.g., a vapor or gaseous refrigerant) from one another. Illustrative liquid separators may include, but are not limited to, scrubbers, liquid-gas separators, rotating separators, stationary separators, or the like.

The pump 110 may be fluidly coupled with and disposed downstream from the first liquid separator 112 via line 154, and may further be fluidly coupled with and disposed upstream of the heat exchanger 106 via lines 156 and 158. The pump 110 may be configured to direct a process fluid containing a liquid phase (e.g., a liquid refrigerant) from the first liquid separator 112 to the heat exchanger 106. For example, the pump 110 may be configured to pressurize the liquid phase from the first liquid separator 112 to direct the liquid phase to the heat exchanger 106. The pump 110 may be configured to pressurize the process fluid from the first liquid separator 112 to a pressure equal or substantially equal to the process fluid discharged from the second compressor 118 and/or the process fluid flowing through line 158. The pump 110 may be an electrically driven pump, a mechanically driven pump, a variable frequency driven pump, or the like.

The heat exchanger 106 may be fluidly coupled with and disposed downstream from the pump 110 and one or more of the liquid separators 112, 114, and configured to receive one or more process fluids therefrom. For example, as illustrated in FIG. 1, the heat exchanger 106 may be fluidly coupled with and disposed downstream from the second liquid separator 114 via line 158 and line 160 and configured to receive a process fluid therefrom. In another example, the heat exchanger 106 may be fluidly coupled with and disposed downstream from the pump 110 via lines 156 and 158 and configured to receive a process fluid therefrom. The heat exchanger 106 may also be fluidly coupled with and disposed upstream of the compression assembly 108 and configured to direct one or more process fluids thereto. For example, as illustrated in FIG. 1, the heat exchanger 106 may be fluidly coupled with and disposed upstream from the first compressor 116 of the compression assembly 108 via line 140 and line 142. As further illustrated in FIG. 1, the heat exchanger 106 may be fluidly coupled with and disposed downstream from the natural gas source 102 via line 162 and configured to receive the feed gas therefrom.

The heat exchanger 106 may be any device capable of directly or indirectly cooling and/or sub-cooling at least a portion of the feed gas flowing therethrough. For example, the heat exchanger 106 may be a wound coil heat exchanger, a plate-fin heat exchanger, a shell and tube heat exchanger, a kettle type heat exchanger, or the like. In at least one embodiment, the heat exchanger 106 may include one or more regions or zones (two are shown 128, 130). For example, as illustrated in FIG. 1, a first zone 128 of the heat exchanger 106 may be a pre-cooling zone, and a second zone 130 of the heat exchanger 106 may be a liquefaction zone. As further described herein, the heat exchanger 106 may be configured to pre-cool the refrigerants and/or the feed gas flowing through the pre-cooling zone 128. The heat exchanger 106 may also be configured to liquefy at least a portion of the feed gas from the natural gas source 102 to the LNG in the liquefaction zone 130.

The liquefaction system 100 may include one or more expansion elements (two are shown 132, 134) configured to receive and expand a process fluid to thereby decrease a temperature and pressure thereof. Illustrative expansion elements 132, 134 may include, but are not limited to, a turbine or turbo-expander, a geroler, a gerotor, an expansion valve, such as a Joule-Thomson (JT) valve, or the like, or any combination thereof. In at least one embodiment, any one or more of the expansion elements 132, 134 may be a turbo-expander (not shown) configured to receive and expand a portion of the process fluid to thereby decrease a temperature and pressure thereof. The turbo-expander (not shown) may be configured to convert the pressure drop of the process fluid flowing therethrough to mechanical energy, which may be utilized to drive one or more devices (e.g., generators, compressors, pumps, etc.). In another embodiment, illustrated in FIG. 1, any one or more of the expansion elements 132, 134 may be expansion valves, such as JT valves. As illustrated in FIG. 1, each of the expansion valves 132, 134 may be fluidly coupled with the heat exchanger 106 and configured to receive and expand a process fluid (e.g., the refrigerant) from the heat exchanger 106 to thereby decrease a temperature and pressure thereof. For example, a first expansion valve 132 may be disposed downstream from the heat exchanger 106 via line 164, and may further be disposed upstream of the heat exchanger 106 via line 166. In another example, a second expansion valve 134 may be disposed downstream from the heat exchanger 106 via line 168, and may further be disposed upstream of the heat exchanger 106 via line 170. In at least one embodiment, the expansion of the process fluid through any one or more of the expansion valves 132, 134 may flash the process fluid into a two-phase fluid including a gaseous or vapor phase and a liquid phase.

As previously discussed, the liquefaction system 100 may be configured to direct or flow a process fluid (e.g., the refrigerant) through one or more refrigerant cycles to cool at least a portion of the feed gas flowing through the feed gas stream. The refrigerant cycles may be a closed-loop refrigerant cycle. The process fluid directed through the refrigerant cycles may be or include a single mixed refrigerant. The single mixed refrigerant may be a multicomponent fluid mixture containing one or more hydrocarbons. Illustrative hydrocarbons may include, but are not limited to, methane, ethane, propane, butanes, pentanes, or the like, or any combination thereof. In at least one embodiment, the single mixed refrigerant may be a multicomponent fluid mixture containing one or more hydrocarbons and one or more non-hydrocarbons. For example, the single mixed refrigerant may be or include a mixture of one or more hydrocarbons and one or more non-hydrocarbons. Illustrative non-hydrocarbons may include, but are not limited to, carbon dioxide, nitrogen, argon, or the like, or any combination thereof. In another embodiment, the single mixed refrigerant may be or include a mixture containing one or more non-hydrocarbons. In an exemplary embodiment, the process fluid directed through the refrigerant cycles may be a single mixed refrigerant containing methane, ethane, propane, butanes, and/or nitrogen. In at least one embodiment, the single mixed refrigerant may include R42, R410a, or the like.

In an exemplary operation, the process fluid containing the single mixed refrigerant may be discharged from the first compressor 116 of the compression assembly 108 and directed to the first cooler 124 via line 144. The process fluid discharged from the first compressor 116 may have a pressure of about 3,000 kPa to about 3,300 kPa or greater. The first cooler 124 may receive the process fluid from the first compressor 116 and cool at least a portion of the single mixed refrigerant contained therein. In at least one embodiment, the first cooler 124 may cool at least a portion of the single mixed refrigerant to a liquid phase. For example, as previously discussed, the single mixed refrigerant may be a multicomponent fluid mixture containing one or more hydrocarbons, and relatively high molecular weight hydrocarbons (e.g., ethane, propane, etc.) may be compressed, cooled, and/or otherwise condensed to the liquid phase before relatively low molecular weight hydrocarbons (e.g., methane). Accordingly, the relatively high molecular weight hydrocarbons of the single mixed refrigerant contained in line 146 may be in the liquid phase, and the relatively low molecular weight hydrocarbons of the single mixed refrigerant in line 146 may be in the gaseous phase. It should be appreciated that relatively high molecular weight hydrocarbons may generally have a boiling point relatively higher than relatively low molecular weight hydrocarbons. In an exemplary embodiment, the first cooler 124 may cool the process fluid from the first compressor 116 to a temperature of about 15° C. to about 25° C. or greater.

The process fluid containing the cooled single mixed refrigerant may be directed to the first liquid separator 112 via line 146, and the first liquid separator 112 may separate at least a portion of the liquid phase and the gaseous phase from one another. For example, the first liquid separator 112 may separate at least a portion of the liquid phase containing the relatively high molecular weight hydrocarbons from the gaseous phase containing the relatively low molecular weight hydrocarbons. The liquid phase from the first liquid separator 112 may be directed to the pump 110 via line 154, and the gaseous phase from the first liquid separator 112 may be directed to the second compressor 118 via line 148.

The second compressor 118 may receive and compress the process fluid containing the gaseous phase from the first liquid separator 112, and direct the compressed process fluid to the second cooler 126 via line 150. In an exemplary embodiment, the second compressor 118 may compress the process fluid containing the gaseous phase to a pressure of about 5,900 kPa to about 6,140 kPa or greater. Compressing the process fluid in the second compressor 118 may generate heat (e.g., the heat of compression) to thereby increase the temperature of the process fluid. Accordingly, the second cooler 126 may cool or remove at least a portion of the heat (e.g., the heat of compression) contained therein. In at least one embodiment, the second cooler 126 may cool at least a portion of the process fluid (e.g., the relatively high molecular eight hydrocarbons) to a liquid phase. The cooled process fluid from the second cooler 126 may be directed to the second liquid separator 114 via line 152.

The second liquid separator 114 may receive the process fluid and separate the process fluid into a liquid phase and a gaseous phase. For example, the second liquid separator 114 may separate at least a portion of the liquid phase containing the condensed portions of the single mixed refrigerant (e.g., the relatively high molecular weight hydrocarbons) from the gaseous phases containing the non-condensed portions of the single mixed refrigerant (e.g., the relatively low molecular weight hydrocarbons). The separated liquid and gaseous phases may then be directed from the second liquid separator 114 to the heat exchanger 106. For example, the liquid phase from the second liquid separator 114 may be directed to the heat exchanger 106 as a first portion of the single mixed refrigerant via line 158. In another example, the gaseous phase from the second liquid separator 114 may be directed to the heat exchanger 106 as a second portion of the single mixed refrigerant via line 160. In at least one embodiment, the liquid phase from the first liquid separator 112 may be combined with the liquid phase from the second liquid separator 114, and the combined liquid phases may be directed to the heat exchanger 106 as the first portion of the single mixed refrigerant. For example, the pump 110 may pressurize or transfer the liquid phase from the first liquid separator 112 to line 158 via line 156. Accordingly, the process fluid in line 158 may include the liquid phase from the second liquid separator 114 and the pressurized liquid phase from the pump 110.

The first portion of the single mixed refrigerant (e.g., the liquid phase) may be directed through the pre-cooling zone 128 of the heat exchanger 106 from line 158 to line 168 to pre-cool the second portion of the single mixed refrigerant (e.g., the gaseous phase) flowing through the heat exchanger 106 from line 160 to line 164. The first portion of the single mixed refrigerant may also be directed through the pre-cooling zone 128 from line 158 to line 168 to pre-cool the feed gas flowing through the feed gas stream from line 162 to line 172. The first portion of the single mixed refrigerant may then be directed to the second expansion valve 134 via line 168, and the second expansion valve 134 may expand the first portion of the single mixed refrigerant to thereby decrease the temperature and pressure thereof. The first portion of the single mixed refrigerant from the second expansion valve 134 may be directed to and through the heat exchanger 106 from line 170 to line 140 to provide further cooling or pre-cooling to the second portion of the single mixed refrigerant and/or the feed gas flowing through the heat exchanger 106.

The second portion of the single mixed refrigerant (e.g., the gaseous phase) from the second liquid separator 114 may be directed through the pre-cooling zone 128 of the heat exchanger 106 from line 160 to line 164. As discussed above, the second portion of the single mixed refrigerant flowing through the heat exchanger 106 from line 160 to line 164 may be pre-cooled by the first portion of the single mixed refrigerant in the pre-cooling zone 128. The pre-cooled second portion of the single mixed refrigerant may then be directed to the first expansion valve 132 via line 164, and the first expansion valve 132 may expand the second portion of the single mixed refrigerant to thereby decrease the temperature and pressure thereof. The second portion of the single mixed refrigerant from the first expansion valve 132 may then be directed to and through the heat exchanger 106 from line 166 to line 142 to cool at least a portion of the feed gas flowing through the feed gas stream from line 162 to line 172. In at least one embodiment, the first and second portions of the single mixed refrigerant flowing through the heat exchanger 106 may sufficiently cool at least a portion of the feed gas flowing through the feed gas stream to the LNG. The LNG produced may be discharged from the heat exchanger 106 via line 172. The discharged LNG in line 172 may be directed to a storage tank 138 via flow control valve 136 and line 174.

The heated or "spent" first portion of the single mixed refrigerant and the "spent" second portion of the single mixed refrigerant from the heat exchanger 106 may be directed to the first compressor 116 of the compression assembly 108 via line 140 and line 142, respectively. The "spent" first and second portions of the single mixed refrigerant may have a pressure relatively greater than ambient pressure. The "spent" first and second portions of the single mixed refrigerant may have the same pressure or different pressures. For example, the "spent" first portion of the single mixed refrigerant in line 140 may have a pressure from about 300 kPa to about 500 kPa, and the "spent" second portion of the single mixed refrigerant in line 142 may have a pressure from about 1,400 kPa to about 1,700 kPa. The "spent" first and second portions of the single mixed refrigerant from the heat exchanger 106 may be directed to any of the one or more stages of the first compressor 116. For example, the "spent" first portion of the single mixed refrigerant may be directed to the first stage of the first compressor 116, and the "spent" second portion of the single mixed refrigerant may be directed to one of the intermediate stages of the first compressor 116. Accordingly, the "spent" second portion of the single mixed refrigerant from the heat exchanger 106 may be directed to the first compressor 116 as a sidestream. The first compressor 116 may receive the "spent" first portion of the single mixed refrigerant and a sidestream of the "spent" second portion of the single mixed refrigerant, and compress the "spent" first and second portions of the single mixed refrigerant through the stages thereof.

The first compressor 116 may combine the "spent" first and second portions of the single mixed refrigerant with one another to thereby provide the compressed process fluid containing the single mixed refrigerant in line 144. The compressed process fluid containing the single mixed refrigerant may then be re-directed through the refrigerant cycle as described above. It should be appreciated that the ability to receive the first portion of the single mixed refrigerant and the second portion of the single mixed refrigerant (e.g., sidestream) at separate stages of a single compressor (e.g., the first compressor 116) may reduce the cost, energy consumption, and/or complexity of the liquefaction system 100. For example, the ability to receive the first portion of the single mixed refrigerant and the second portion of the single mixed refrigerant in a single compressor (e.g., the first compressor 116) at a first pressure (e.g., about 300 kPa to about 500 kPa) and a second pressure (e.g., about 1,400 kPa to about 1,700 kPa), respectively, may reduce the number of compressors 116, 118 utilized in the liquefaction system 100. In another example, the ability to receive the first portion of the single mixed refrigerant at the first stage of the single compressor (e.g., the first compressor 116) and the second portion of the single mixed refrigerant (e.g., as a sidestream) at an intermediate stage of the single compressor may reduce energy consumption and increase an efficiency of the liquefaction system 100.

Figure 2:
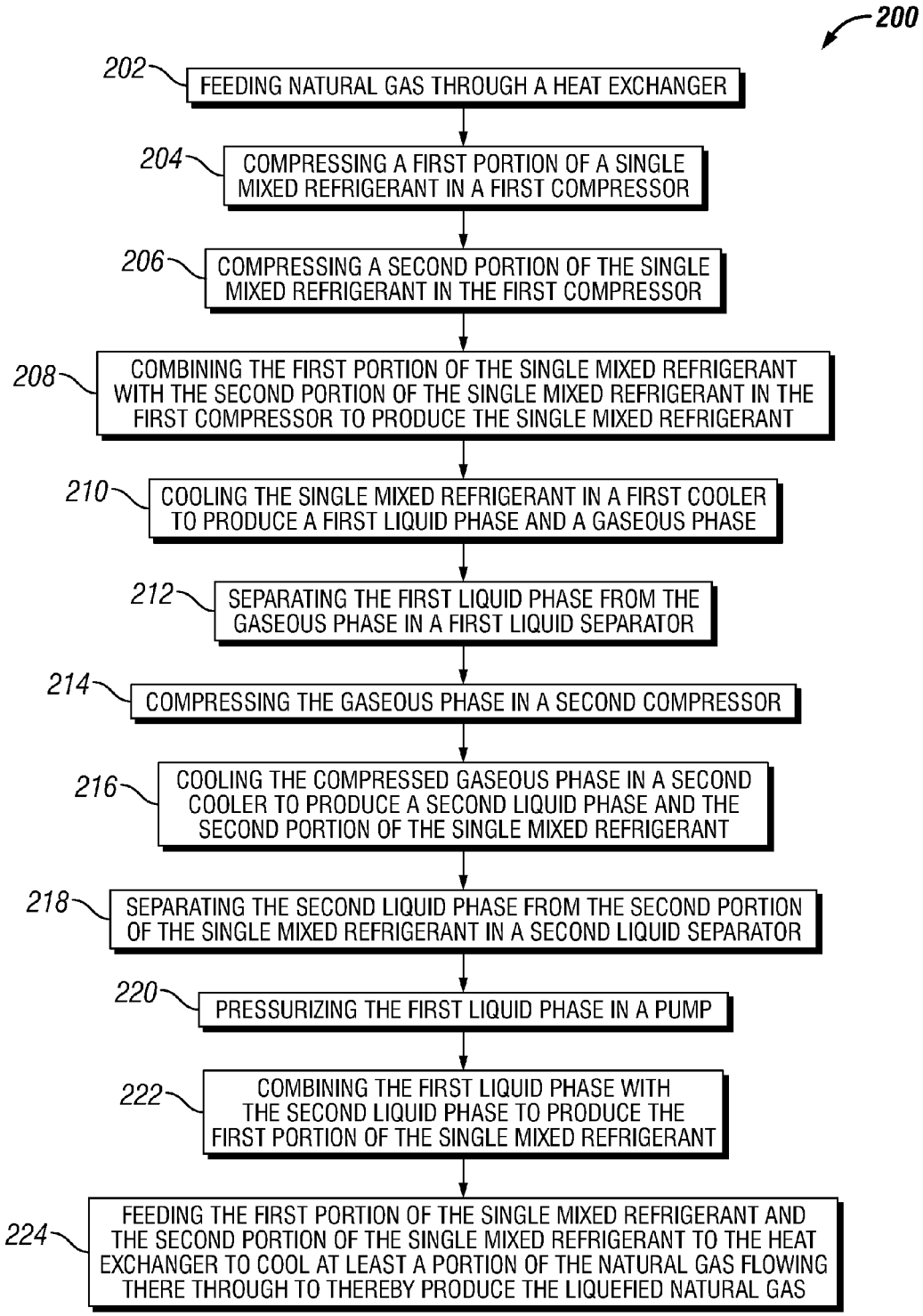
FIG. 2 illustrates a flowchart of a method for producing liquefied natural gas, according to one or more embodiments disclosed.

FIG. 2 illustrates a flowchart of a method 200 for producing liquefied natural gas, according to one or more embodiments. The method 200 may include feeding natural gas through a heat exchanger, as shown at 202. The method 200 may also include compressing a first portion of a single mixed refrigerant in a first compressor, as shown at 204. The method 200 may further include compressing a second portion of the single mixed refrigerant in the first compressor, as shown at 206. The method 200 may also include combining the first portion of the single mixed refrigerant with the second portion of the single mixed refrigerant in the first compressor to produce the single mixed refrigerant, as shown at 208. The method 200 may also include cooling the single mixed refrigerant in a first cooler to produce a first liquid phase and a gaseous phase, as shown at 210. The method 200 may also include separating the first liquid phase from the gaseous phase in a first liquid separator, as shown at 212. The method 200 may also include compressing the gaseous phase in a second compressor, as shown at 214. The method 200 may also include cooling the compressed gaseous phase in a second cooler to produce a second liquid phase and the second portion of the single mixed refrigerant, as shown at 216. The method 200 may also include separating the second liquid phase from the second portion of the single mixed refrigerant in a second liquid separator, as shown at 218. The method 200 may also include pressurizing the first liquid phase in a pump, as shown at 220. The method 200 may also include combining the first liquid phase with the second liquid phase to produce the first portion of the single mixed refrigerant, as shown at 222. The method 200 may also include feeding the first portion of the single mixed refrigerant and the second portion of the single mixed refrigerant to the heat exchanger to cool at least a portion of the natural gas flowing therethrough to thereby produce the liquefied natural gas, as shown at 224.

Figure 3:
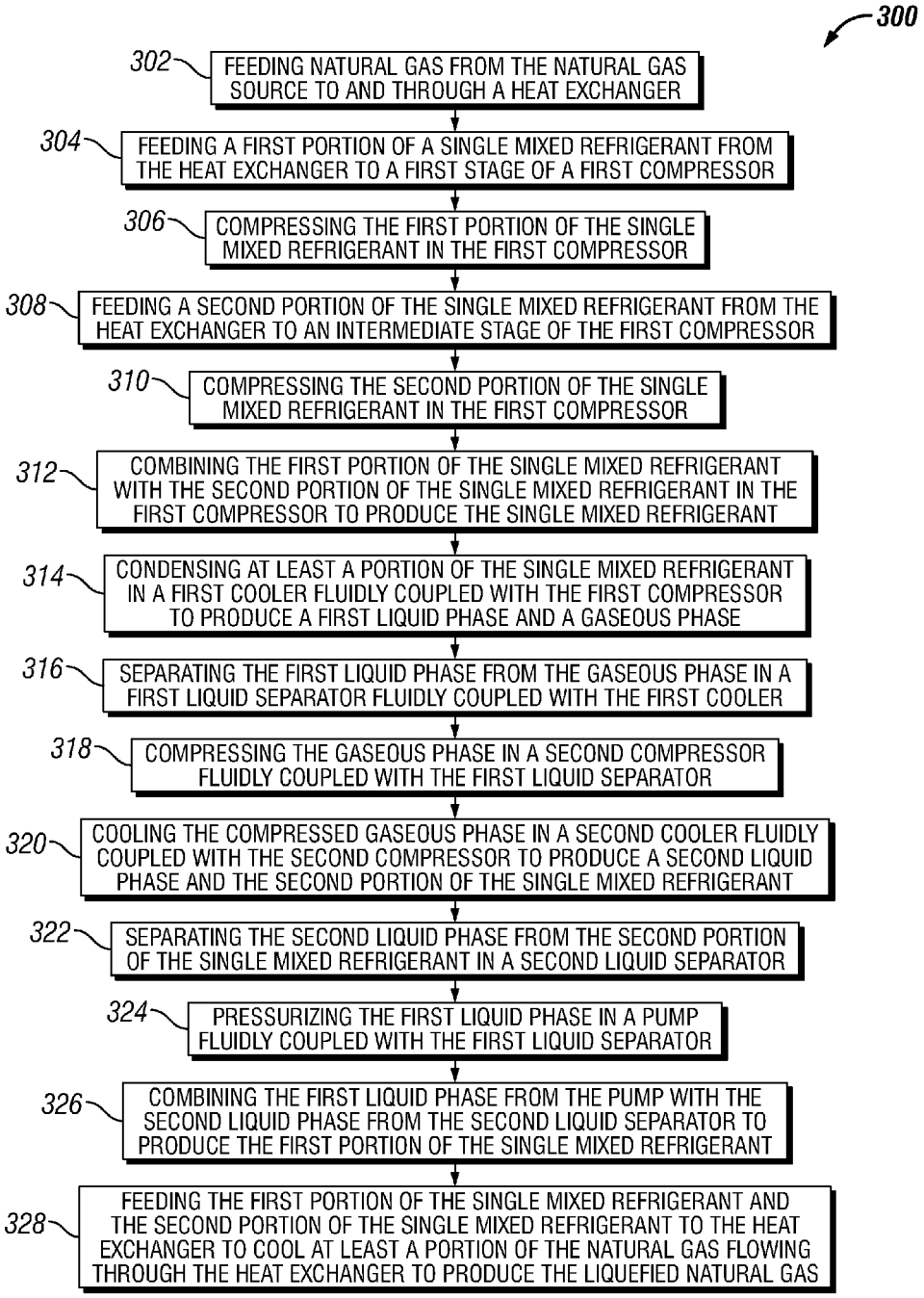
FIG. 3 illustrates a flowchart of a method for producing liquefied natural gas from a natural gas source, according to one or more embodiments disclosed.

FIG. 3 illustrates a flowchart of a method 300 for producing liquefied natural gas from a natural gas source, according to one or more embodiments. The method 300 may include feeding natural gas from the natural gas source to and through a heat exchanger, as shown at 302. The method 300 may also include feeding a first portion of a single mixed refrigerant from the heat exchanger to a first stage of a first compressor, as shown at 304. The method 300 may further include compressing the first portion of the single mixed refrigerant in the first compressor, as shown at 306. The method 300 may also include feeding a second portion of the single mixed refrigerant from the heat exchanger to an intermediate stage of the first compressor, as shown at 308. The method 300 may also include compressing the second portion of the single mixed refrigerant in the first compressor, as shown at 310. The method 300 may also include combining the first portion of the single mixed refrigerant with the second portion of the single mixed refrigerant in the first compressor to produce the single mixed refrigerant, as shown at 312. The method 300 may also include condensing at least a portion of the single mixed refrigerant in a first cooler fluidly coupled with the first compressor to produce a first liquid phase and a gaseous phase, as shown at 314. The method 300 may also include separating the first liquid phase from the gaseous phase in a first liquid separator fluidly coupled with the first cooler, as shown at 316. The method 300 may also include compressing the gaseous phase in a second compressor fluidly coupled with the first liquid separator, as shown at 318. The method 300 may also include cooling the compressed gaseous phase in a second cooler fluidly coupled with the second compressor to produce a second liquid phase and the second portion of the single mixed refrigerant, as shown at 320. The method 300 may also include separating the second liquid phase from the second portion of the single mixed refrigerant in a second liquid separator, as shown at 322. The method 300 may also include pressurizing the first liquid phase in a pump fluidly coupled with the first liquid separator, as shown at 324. The method 300 may also include combining the first liquid phase from the pump with the second liquid phase from the second liquid separator to produce the first portion of the single mixed refrigerant, as shown at 326. The method 300 may also include feeding the first portion of the single mixed refrigerant and the second portion of the single mixed refrigerant to the heat exchanger to cool at least a portion of the natural gas flowing through the heat exchanger to produce the liquefied natural gas, as shown at 328.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

We claim:

1. A method for producing liquefied natural gas, comprising:

fluidly coupling a source of natural gas to an inlet of a heat exchanger;

feeding natural gas from the source of natural gas through the inlet of the heat exchanger;

compressing a first portion of a single mixed refrigerant in a first compressor;

compressing a second portion of the single mixed refrigerant in the first compressor;

combining the first portion of the single mixed refrigerant with the second portion of the single mixed refrigerant in the first compressor to produce the single mixed refrigerant;

cooling the single mixed refrigerant in a first cooler to produce a first liquid phase and a gaseous phase;

separating the first liquid phase from the gaseous phase in a first liquid separator;

compressing the gaseous phase in a second compressor;

cooling the compressed gaseous phase in a second cooler to produce a second liquid phase and the second portion of the single mixed refrigerant;

separating the second liquid phase from the second portion of the single mixed refrigerant in a second liquid separator;

pressurizing the first liquid phase in a pump fluidly coupled with the first liquid separator;

combining the first liquid phase from the pump with the second liquid phase from the second liquid separator to produce the first portion of the single mixed refrigerant;

feeding the first portion of the single mixed refrigerant and the second portion of the single mixed refrigerant to the heat exchanger to cool at least a portion of the natural gas fed to the heat exchanger from the source of natural gas to produce the liquefied natural gas;

fluidly coupling a storage tank to an outlet of the heat exchanger; and feeding the liquefied natural gas into the storage tank through the outlet of the heat exchanger.

2. The method of claim 1, wherein compressing the first portion of the single mixed refrigerant in the first compressor comprises receiving the first portion of the single mixed refrigerant from the heat exchanger at a first stage of the first compressor.

3. The method of claim 1, wherein compressing the second portion of the single mixed refrigerant in the first compressor comprises receiving the second portion of the single mixed refrigerant from the heat exchanger at an intermediate stage of the first compressor.

4. The method of claim 1, wherein feeding the natural gas through the heat exchanger comprises:

feeding the natural gas through a pre-cooling zone of the heat exchanger; and feeding the natural gas through a liquefaction zone of the heat exchanger.

5. The method of claim 4, further comprising storing the liquefied natural gas in a storage tank fluidly coupled with the liquefaction zone of the heat exchanger.

6. The method of claim 1, wherein feeding the first portion of the single mixed refrigerant and the second portion of the single mixed refrigerant to the heat exchanger comprises:

feeding the first portion of the single mixed refrigerant through a pre-cooling zone of the heat exchanger;

feeding the second portion of the single mixed refrigerant through the pre-cooling zone; and pre-cooling the second portion of the single mixed refrigerant with the first portion of the single mixed refrigerant in the pre-cooling zone.

7. The method of claim 6, wherein feeding the first portion of the single mixed refrigerant and the second portion of the single mixed refrigerant to the heat exchanger further comprises:

feeding the first portion of the single mixed refrigerant from the pre-cooling zone of the heat exchanger to an expansion valve fluidly coupled with the heat exchanger;

expanding the first portion of the single mixed refrigerant through the expansion valve to cool the first portion of the single mixed refrigerant; and feeding the cooled first portion of the single mixed refrigerant from the expansion valve to the heat exchanger to cool the pre-cooled second portion of the single mixed refrigerant.

8. The method of claim 6, wherein feeding the first portion of the single mixed refrigerant and the second portion of the single mixed refrigerant to the heat exchanger further comprises:

feeding the pre-cooled second portion of the single mixed refrigerant from the pre-cooling zone of the heat exchanger to an expansion valve fluidly coupled with the heat exchanger;

expanding the pre-cooled second portion of the single mixed refrigerant through the expansion valve to cool the pre-cooled second portion of the single mixed refrigerant; and feeding the cooled second portion of the single mixed refrigerant from the expansion valve to the heat exchanger to cool the natural gas flowing therethrough.

9. The method of claim 1, wherein the single mixed refrigerant comprises methane, ethane, propane, butanes, and nitrogen.

10. A method for producing liquefied natural gas from a natural gas source, comprising:

fluidly coupling a source of natural gas to an inlet of a heat exchanger;

feeding natural gas from the source of natural gas to and through the inlet of the heat exchanger;

feeding a first portion of a single mixed refrigerant from the heat exchanger to a first stage of a first compressor;

compressing the first portion of the single mixed refrigerant in the first compressor;

feeding a second portion of the single mixed refrigerant from the heat exchanger to an intermediate stage of the first compressor;

compressing the second portion of the single mixed refrigerant in the first compressor;

combining the first portion of the single mixed refrigerant with the second portion of the single mixed refrigerant in the first compressor to produce the single mixed refrigerant;

condensing at least a portion of the single mixed refrigerant in a first cooler fluidly coupled with the first compressor to produce a first liquid phase and a gaseous phase;

separating the first liquid phase from the gaseous phase in a first liquid separator fluidly coupled with the first cooler;

compressing the gaseous phase in a second compressor fluidly coupled with the first liquid separator;

cooling the compressed gaseous phase in a second cooler fluidly coupled with the second compressor to produce a second liquid phase and the second portion of the single mixed refrigerant;

separating the second liquid phase from the second portion of the single mixed refrigerant in a second liquid separator;

pressurizing the first liquid phase in a pump fluidly coupled with the first liquid separator;

combining the first liquid phase from the pump with the second liquid phase from the second liquid separator to produce the first portion of the single mixed refrigerant;

feeding the first portion of the single mixed refrigerant and the second portion of the single mixed refrigerant to the heat exchanger to cool at least a portion of the natural gas fed to the heat exchanger from the source of natural gas to produce the liquefied natural gas;

fluidly coupling a storage tank to an outlet of the heat exchanger; and feeding the liquefied natural gas into the storage tank through the outlet of the heat exchanger.

11. The method of claim 10, wherein feeding the first portion of the single mixed refrigerant and the second portion of the single mixed refrigerant to the heat exchanger comprises:

feeding the first portion of the single mixed refrigerant through a pre-cooling zone of the heat exchanger;

feeding the second portion of the single mixed refrigerant through the pre-cooling zone;

pre-cooling the second portion of the single mixed refrigerant with the first portion of the single mixed refrigerant in the pre-cooling zone;

feeding the first portion of the single mixed refrigerant from the pre-cooling zone of the heat exchanger to a first expansion valve fluidly coupled with the heat exchanger;

expanding the first portion of the single mixed refrigerant through the first expansion valve to cool the first portion of the single mixed refrigerant;

redirecting the cooled first portion of the single mixed refrigerant back to the heat exchanger to cool the pre-cooled second portion of the single mixed refrigerant;

feeding the pre-cooled second portion of the single mixed refrigerant from the pre-cooling zone of the heat exchanger to a second expansion valve fluidly coupled with the heat exchanger;

expanding the pre-cooled second portion of the single mixed refrigerant through the second expansion valve to cool the pre-cooled second portion of the single mixed refrigerant; and feeding the cooled second portion of the single mixed refrigerant to a liquefaction zone of the heat exchanger to cool the natural gas flowing therethrough.

12. The method of claim 11, wherein feeding the natural gas from the natural gas source to and through the heat exchanger comprises:

precooling the natural gas in the pre-cooling zone of the heat exchanger; and liquefying at least a portion of the natural gas in the liquefaction zone of the heat exchanger.

13. The method of claim 12, further comprising storing the liquefied natural gas in a storage tank fluidly coupled with the liquefaction zone of the heat exchanger.

14. The method of claim 10, further comprising driving the first compressor and the second compressor with a steam turbine, the steam turbine coupled with the first compressor and the second compressor via a rotary shaft.

15. The method of claim 10, further comprising driving the first compressor and the second compressor with a gas turbine, the gas turbine coupled with the first compressor and the second compressor via a rotary shaft.

16. The method of claim 10, wherein the single mixed refrigerant comprises methane, ethane, propane, butanes, and nitrogen.

17. A liquefaction system, comprising:

a heat exchanger including an inlet and an outlet, the heat exchanger configured to receive natural gas through the inlet and cool at least a portion of the natural gas to produce liquefied natural gas;

a first compressor fluidly coupled with the heat exchanger and configured to compress a first portion of a single mixed refrigerant and a second portion of the single mixed refrigerant from the heat exchanger, and combine the first portion of the single mixed refrigerant with the second portion of the single mixed refrigerant to produce the single mixed refrigerant;

a first cooler fluidly coupled with the first compressor and configured to cool the single mixed refrigerant from the first compressor to produce a first liquid phase and a gaseous phase;

a first liquid separator fluidly coupled with the first cooler and configured to separate the first liquid phase from the gaseous phase;

a second compressor fluidly coupled with the first liquid separator and configured to compress the gaseous phase from the first liquid separator;

a second cooler fluidly coupled with the second compressor and configured to cool the compressed gaseous phase from the second compressor to produce a second liquid phase and the second portion of the single mixed refrigerant;

a second liquid separator fluidly coupled with the second cooler and the heat exchanger, and configured to separate the second liquid phase from the second portion of the single mixed refrigerant, and discharge the second portion of the single mixed refrigerant to the heat exchanger; and a pump fluidly coupled with the first liquid separator and the heat exchanger, and configured to pressurize the first liquid phase from the first liquid separator to combine the first liquid phase with the second liquid phase from the second liquid separator to produce the first portion of the single mixed refrigerant, and wherein the outlet of the heat exchanger is connected to feed the liquefied natural gas produced in the heat exchanger into a storage tank.

18. The liquefaction system of claim 17, wherein the heat exchanger includes a pre-cooling zone and a liquefaction zone.

19. The liquefaction system of claim 17, further comprising:

a first expansion valve fluidly coupled with the heat exchanger and configured to expand the first portion of the single mixed refrigerant from the heat exchanger; and a second expansion valve fluidly coupled with the heat exchanger and configured to expand the second portion of the single mixed refrigerant from the heat exchanger.

20. The liquefaction system of claim 17, wherein the heat exchanger is fluidly coupled with a first stage and an intermediate stage of the first compressor via a first line and a second line, respectively, and configured to feed the first portion of the single mixed refrigerant and the second portion of the single mixed refrigerant to the first stage and the intermediate stage via the first line and the second line, respectively.

* * * * *